US005701777A

United States Patent [19]

Yamanaka et al.

[11] Patent Number: 5,701,777

[45] Date of Patent: Dec. 30, 1997

[54] DRAWING METHOD AND APPARATUS

[75] Inventors: Naoki Yamanaka; Kazutoshi Tsuge, both of Toyota, Japan

[73] Assignee: Toyota Jidosha Kabushiki Kaisha, Toyota, Japan

[21] Appl. No.: 685,419

[22] Filed: Jul. 22, 1996

[30] Foreign Application Priority Data

Jul. 24, 1995 [JP] Japan ..... 7-187518

[51] Int. Cl.[6] ..... B21D 22/00; B21D 22/21

[52] U.S. Cl. ..... 72/350; 72/361

[58] Field of Search ..... 72/350, 361, 312, 72/347, 348, 349, 419, 293

[56] References Cited

FOREIGN PATENT DOCUMENTS

A-01 317 630 12/1989 Japan .
4-17316 2/1992 Japan .

OTHER PUBLICATIONS

Patent Abstracts of Japan, Publication No. JP-A-01 317630, published 22 Dec. 1989 for Application No. JP890027603.

"Zieheinrichtungen im Pressentisch einfach-wirkender Pressen" wt Werkstattstechnik 81 (1991), vol. 81, No. 6, 1 Jun. 1991, pp. 327-330.

*Primary Examiner*—Lowell A. Larson
*Assistant Examiner*—Rodney A. Butler
*Attorney, Agent, or Firm*—Cushman, Darby & Cushman IP Group of Pillsbury Madison & Sutro LLP

[57] ABSTRACT

A drawing apparatus includes blank holder and an opposing die for holding a blank therebetween, and a punch for drawing the blank. The blank holder and the opposing die include respective blank holding surfaces in which beads, having at least a portion that varies in distance from a drawing profile, are formed. In a drawing method conducted using the apparatus, a blank holder is lowered to hold the blank between the blank holder and the opposing die, and then the blank holder is further lowered so that the held blank is drawn by the punch.

10 Claims, 7 Drawing Sheets

DRAWING METHOD AND APPARATUS

BACKGROUND OF THE INVENTION

1. Field of the Invention

The present invention relates to a drawing method and apparatus which increases a bead resistance without reducing a bead clearance.

2. Description of Related Art

As disclosed in Japanese Utility Model Publication No. HEI 4-17316, in a lock drawing, a convex lock bead is formed in a blank holding surface (a binder surface) of one of an upper die and a cushion ring and a concave lock bead is formed in a blank holding surface of the other. When a blank is held between the die and the cushion ring, the blank is squeezed between the beads so that the blank is locked at the lock beads and drawing is performed under the locked condition.

Such lock forming is used when drawing a panel to a shallowly formed panel such as an automobile door, hood, and outer luggage panel. In a conventional lock forming, as illustrated in FIGS. 11–14, the drawing beads 1' include a convex bead 10' formed in one of the blank holding surfaces 8 and 11 of an upper die 5 and a cushion ring 6 and a concave bead 9' formed in the other of the blank holding surfaces. When the blank holding surfaces 8 and 11 squeeze a blank 12 therebetween, a portion of the blank is formed by the convex bead 10' moving into the concave bead 9' thereby the blank 12 is locked at the portion not so as to move relative to the bead 1' in a direction perpendicular to the bead extending direction during drawing. Then, while the portion of the blank 12 is being locked at the beads 1', the upper die 5 and the cushion ring 6 are further lowered so that the blank 12 is completely formed by the upper die 5 and a lower die 7. During drawing, no stress is generated at a region of the blank outside the beads (region R of FIG. 11), and a tensile stress $\sigma$ is generated at a region of the blank inside the beads (region Q of FIG. 11).

In the conventional beads 1', the beads have a shape that is parallel to a drawing profile (which corresponds to an outer profile 2 of the lower die 7 or an inner profile 3 of the cushion ring 6). The cross section of the beads 1' is, for example, trapezoidal so that a resistance greater than a tensile strength of the blank 12 is obtained at the beads when a portion of the blank is squeezed between the side surface of the convex bead and the side surface of the concave bead.

However, drawing performed using the conventional beads exhibits the following problems:

(1) It takes much time (for example, about 80 hours per clearance adjustment) to adjust a clearance e' (FIG. 13) between the side surface of the convex bead and the side surface of the concave bead and a clearance between the blank holding surface of the die and the blank holding surface of the cushion ring.

(2) Because the cushion ring tilts a little while drawing is performed, a dynamic or actual clearance during drawing (FIG. 14) will differ from a static or design clearance (FIG. 13). For example, when the cushion ring tilts in a direction shown by arrow A in FIG. 14, a clearance between the blank holding surfaces at region c becomes large while the clearance at region d becomes small. Therefore, it is considerably difficult to keep the dynamic clearance at the design value throughout the drawing.

(3) A clearance between the side surface of the convex bead and the side surface of the concave bead will change according to a change in an air pressure of a cushion ring supporting cylinder and an abrasion of the side surfaces of the beads caused during drawing. When the clearance increases, an angle $\theta$ (FIG. 13) of a bent portion of the blank at the beads decreases which reduces the friction force at the beads. As a result, the blank will easily slip and pass through the bead and the lock forming becomes unstable.

(4) In order to keep the bead resistance large, the angle $\theta$ (FIG. 13) should be large, and a radius $r_d$ of a corner of the concave bead (between the side surface of the concave bead and the blank holding surface) and a radius $r_b$ of a corner of the convex bead (between the side surface of the convex bead and a top surface of the convex bead) should be small. Further, a clearance e' between the side surface of the convex bead and the side surface of the concave bead should be small. However, in the case where these conditions are satisfied (especially, when the clearance e' is small), when the blank is drawn, the blank will be scratched by the beads and some portion of a plated layer (a zinc-plated layer of a galvanized steel sheet) will peel off. The peeled metal will adhere to the surfaces of the blank holder and the die, which will degrade the surface quality of the formed panel. Further, if the clearance is increased and a portion of the blank passes through the beads, the portion of the blank will bend back and forth at the beads to cause hardening and a decrease in thickness. When the amount of plastic deformation is large, the blank may be damaged.

SUMMARY OF THE INVENTION

An object of the present invention is to provide a drawing method and apparatus which can increase a bead resistance without reducing a clearance between a side surface of a convex bead and a side surface of a concave bead.

In a drawing method and apparatus according to the present invention, a blank holder and a die include respective blank holding surfaces for holding a blank therebetween. Beads (a convex bead and a concave bead) having at least a portion which is non-parallel to or varies in distance from a drawing profile of a blank are formed in the blank holding surfaces. When the blank is drawn by the punch, a portion of the blank located outside the beads will move toward the beads. The portion of the blank moves relative to the beads in a direction perpendicular to the beads causing a stress component tangential to the beads in the blank, thereby increasing a bead resistance. As a result, in a case where the bead clearance is maintained at the same value as that of the conventional beads, the bead resistance is greater than that of the conventional beads, and in a case where the bead resistance is maintained at the same value as that of the conventional beads, the bead clearance is allowed to be greater than that of the conventional beads.

BRIEF DESCRIPTION OF THE DRAWINGS

The above and other objects, features, and advantages of the present invention will become more apparent and will be more readily appreciated from the following detailed description of the preferred embodiment of the present invention in conjunction with the accompanying drawings, in which.

DETAILED DESCRIPTION OF THE PREFERRED EMBODIMENT

Figure 1:
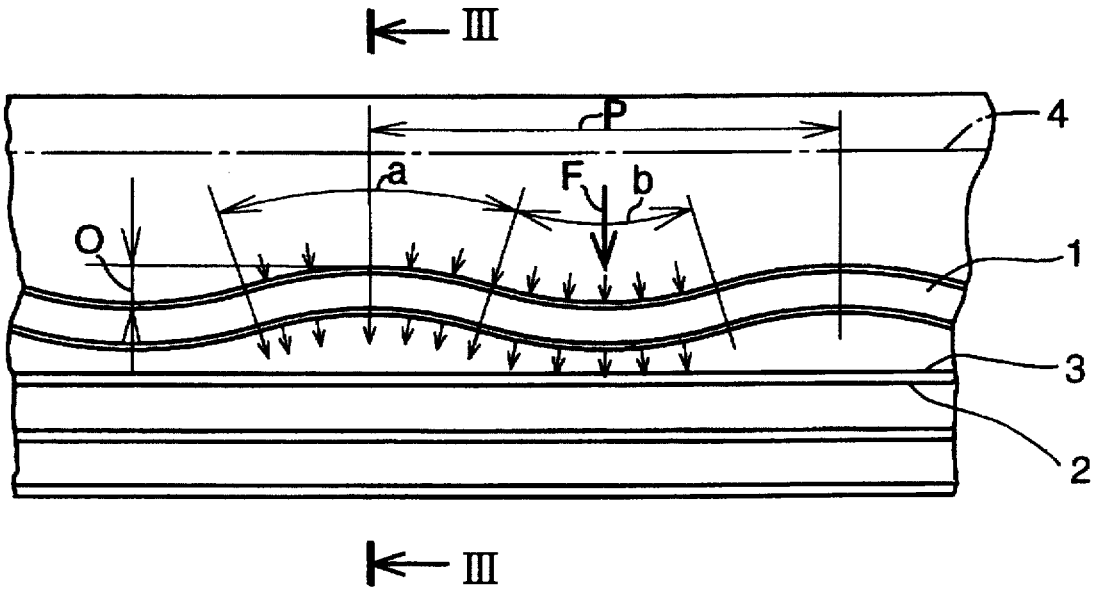
FIG. 1 is a partial plane view of a blank holding surface and a bead of a cushion ring of a drawing apparatus used in conducting a drawing method according to the present invention.
Figure 2:
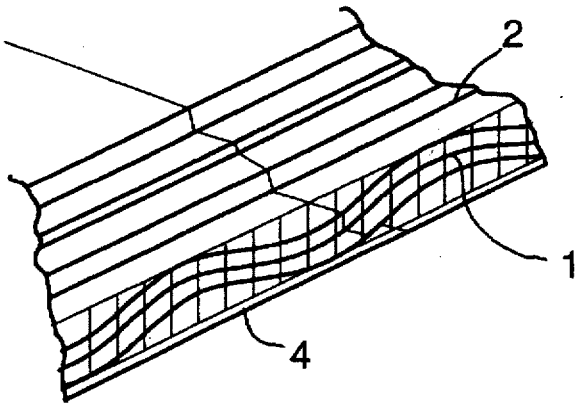
FIG. 2 is an oblique view of the blank holding surface and the bead of FIG. 1.

A drawing method and apparatus according to the present invention is applicable to any of a single-action drawing and a double-action drawing. FIGS. 1–9 illustrate the drawing method and apparatus according to the present invention, with regard to a single-action drawing, as an example.

Figure 8:
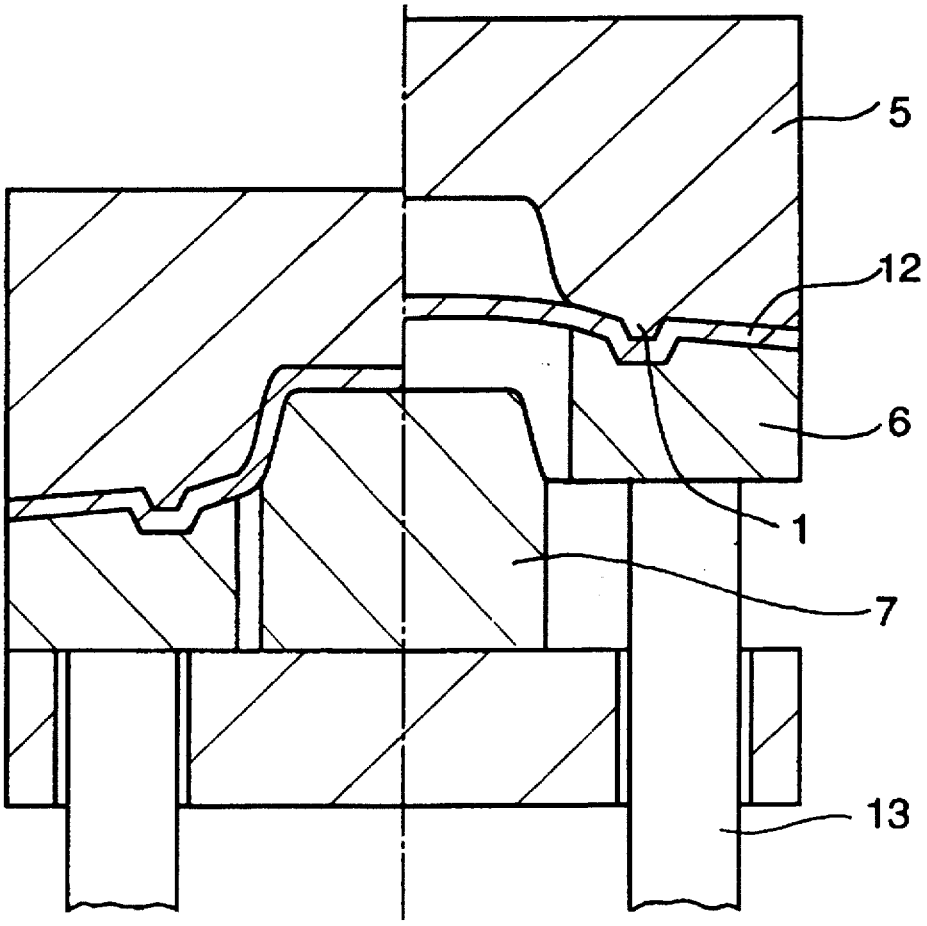
FIG. 8 is a cross-sectional view of a single-action drawing apparatus in which a drawing method according to the present invention is conducted, wherein the left side portion thereof is shown in a position after forming and the right side portion thereof is shown in a position before forming.
Figure 9:
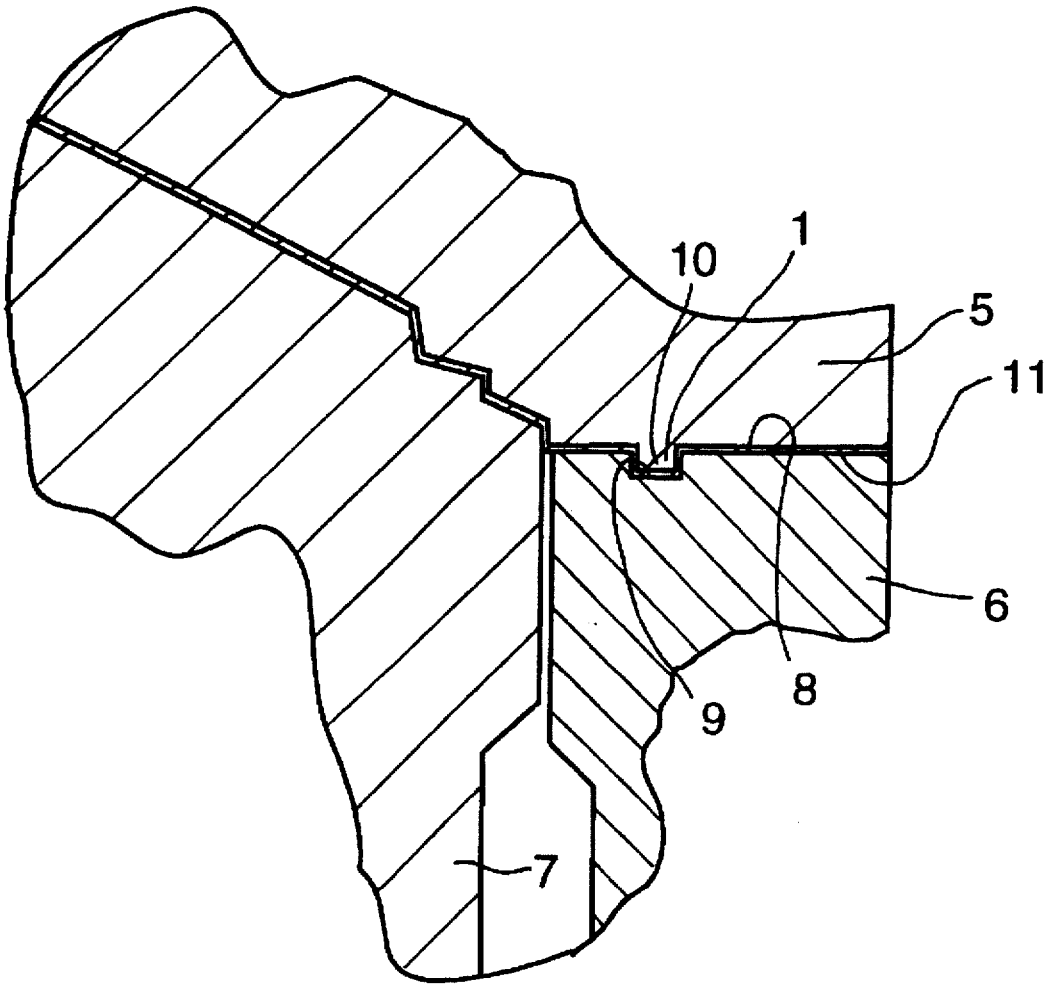
FIG. 9 is a cross-sectional view of beads formed in a cushion ring and a die having cross-sections different from those of the beads of FIG. 3.

As illustrated in FIG. 8, the drawing apparatus according to an embodiment of the present invention includes an upper die 5 movable in a vertical direction, a cushion ring (which may be called a blank holder) 6 movable in the vertical direction when pushed by the upper die 5, and a stationary lower die 7. The upper die 5 is a die opposing the cushion ring 6.

Figure 3:
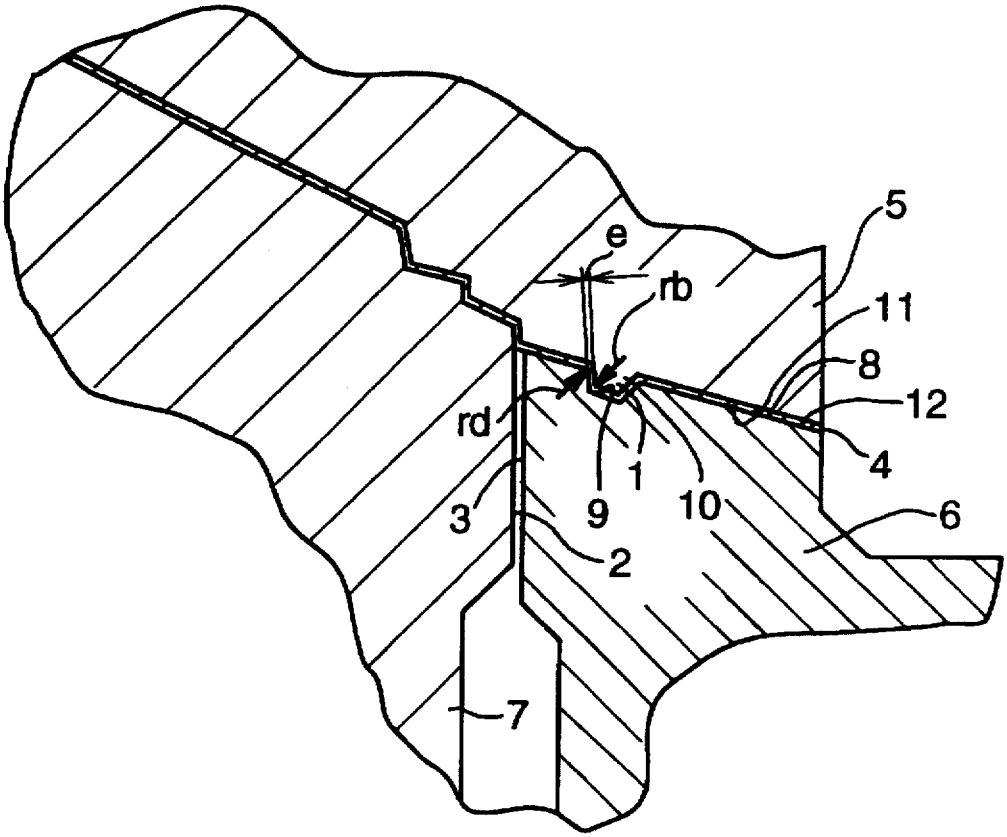
FIG. 3 is a cross-sectional view of the cushion ring and a die taken along line III—III of FIG. 1.

As shown in FIG. 3, the upper die 5 has a blank holding surface (a binder surface) 11, and the cushion ring 6 has a blank holding surface (a binder surface 8). The blank holding surfaces 11 and 8 hold a blank 12 therebetween. The upper die 5 and the cushion ring 6 have drawing beads (hereinafter, beads) 1 which include a convex bead (a bead protrusion) 10 formed in one of the blank holding surfaces 11 and 8 and a concave bead (a bead groove) 9 formed in the other of the blank holding surfaces 11 and 8. Though in the embodiment shown in FIG. 3 the convex bead 10 is formed in the upper die 5 and the concave bead 9 is formed in the cushion ring 6, it can be appreciated that the convex bead 10 may be formed in the cushion ring 6 and the concave bead 9 may be formed in the upper die 5. The beads 1 have, in the entire length thereof, at least a portion which is non-parallel to a drawing profile.

More particularly, the upper die 5 is fixed to an upper ram of a press machine (not shown) and is moved in the vertical direction together with the upper ram. The cushion ring 6 is ring shaped, for example, a rectangular ring, and is not limited to a circular ring. The cushion ring 6 has a lowermost end coupled to a cushion ring support cylinder 13 (which is, for example, a hydraulic cylinder) via a pin and is moved in the vertical direction by the cushion ring support cylinder via the pin. When the upper die 5 is lowered, the cushion ring 6 is pushed downward by the upper ring 5 despite the biasing force from the cushion ring support cylinder. Due to the force from the cushion ring support cylinder, the blank 12 is held and squeezed between the upper die 5 and the cushion ring 6, and a material bead portion is press-formed in the blank 12 when squeezed by the beads 1.

The lower die 7 is fixed directly or indirectly to a stationary member (for example, a bolster) of the press machine and is disposed inside the cushion ring 6. When the upper die 5 lowers the cushion ring 6 and the blank 12, and the blank 12 is brought into contact with the lower die 7, drawing of the blank 12 begins. When the blank 12 is contacted between and pressed by the upper die 5 and the lower die 7, the drawing is completed. The blank holding surfaces 11 and 8 prevent a wrinkle from being formed in the blank during drawing, and the beads 1 and the blank holding surfaces 11 and 8 prevent a portion of the blank from moving toward the lower die 7 through the beads 1 during drawing. If the blank is moved relative to the beads 1, and end 4 of the blank 12 moves in a direction denoted with arrow F in FIG. 1.

Figure 5:
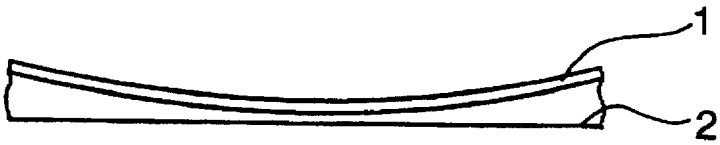
FIG. 5 is a partial plane view of a bead of the invention having another profile.
Figure 6:
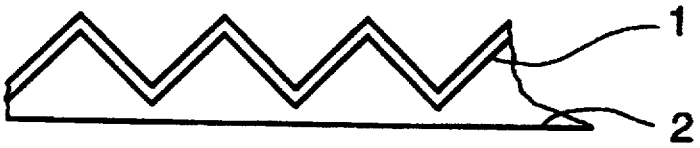
FIG. 6 is a partial plane view of a bead of the invention having a third profile.
Figure 7:
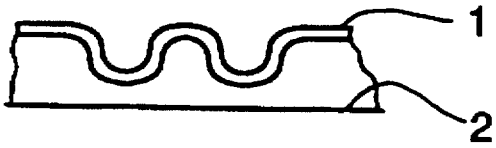
FIG. 7 is a partial plane view of a bead of the invention having a fourth profile.

A profile of the portion of the beads 1 that is non-parallel to a drawing profile (the drawing profile being identical with an outside profile 2 of the lower die 7 and parallel with an inside profile 3 of the cushion ring 6) may be in the form of a wave curve, such as a cosine curve (or a sine curve) as shown in FIG. 1. In other words the profile of the portion of the beads that is non-parallel to a drawing profile varies in distance from the drawing profile. The profile may have a portion inclined with respect to the drawing profile, such as a curve as shown in FIG. 5 or a zigzag profile as shown in FIG. 6 or a profile having a plurality of portions protruding on one side from a line as shown in FIG. 7. Preferably, the non-parallel portion of the beads 1 has an axis of symmetry, with respect to which a left side and a right side of the non-parallel portion are symmetric to each other, so that tangential components of stresses caused along the right side portion and the left side portion of the beads are balanced with each other thereby preventing the blank from moving relative to the beads in a tangential direction of the beads during drawing.

The beads 1 have, for example, a trapezoidal cross-section (FIG. 3), or a rectangular cross-section (see FIG. 9), when viewed along a line perpendicular to a longitudinal direction of the beads 1. In the embodiment of FIG. 3, the beads 1 have a trapezoidal cross-section.

A drawing method according to the present invention is performed using the above-described drawing apparatus. In single-action drawing, as illustrated in FIG. 8, the blank 12 is held between the cushion ring (the blank holder) 6 and the upper die (the opposing die) 5. Then, the upper die is lowered together with the cushion ring 6, and the blank 12 is drawn by the punch (the lower die) 7.

More particularly, the cushion ring 6 is raised by operating the cushion ring support cylinder 13, and a blank 12 is put on the cushion ring 6.

Then, the upper die 5 is lowered and the blank 12 is held between the blank holding surfaces 11 and 8 of the upper die 5 and the cushion ring 6. At the same time, a bead portion is formed in the blank 12 when the blank 12 is pressed between the convex bead 10 and the concave bead 9, and the blank 12 is squeezed between the beads 1. The beads 1 have a portion non-parallel to the drawing profile. The bead clearance e (a clearance between the side surface of the convex bead and the side surface of the concave bead) is preset greater than the conventional bead clearance e'.

Then, the upper die 5 is lowered further to lower the cushion ring 6 and the blank 12, so that the blank 12 is drawn by the upper die 5 and the stationary lower die 7.

By using the non-parallel beads, the bead resistance is effectively increased as explained below.

Figure 4:
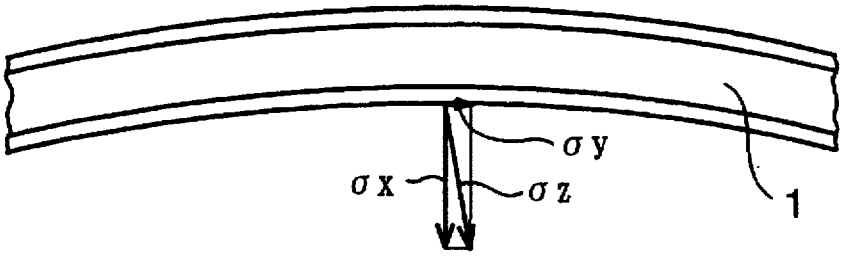
FIG. 4 is a partial plane view of the bead illustrating a mechanism of the invention generating a compression stress at a portion of the bead that is non-parallel to a drawing profile.

When the blank 12 moves relative to the beads 1 in the direction perpendicular to the beads 1 during drawing, a compressive stress is caused in parallel with the drawing profile at a range inside a portion (a) of the beads 1 (an outwardly convex portion) in FIG. 1, and a tensile stress is caused in parallel with the drawing profile at a range outside the portion (a) of the beads 1. This compressive stress, which is not caused by the conventional beads, greatly increases the bead resistance. Further, as illustrated in FIG. 4, when a portion of the blank 12 passes through the beads in the direction perpendicular to the beads 1, a stress component $\sigma_y$ tangential to the beads is caused, which means that the bead resistance is increased compared with the conventional bead resistance.

Similarly, when the blank 12 moves relative to the beads 1 in the direction perpendicular to the beads 1 during drawing, a compressive stress is caused in parallel with the drawing profile at a range outside a portion (b) of the beads 1 (an outwardly concave portion) in FIG. 1, and a tensile stress is caused in parallel with the drawing profile at a range inside the portion (b) of the beads 1 to increase the bead resistance of the portion (b) of the beads. In this instance, the smaller the pitch P of the wave of the non-parallel portion is and the greater the height 0 of the wave, the greater the bead resistance is.

As a result, while a blank holding force of 160 tons was necessary when using the conventional beads and a blank movement relative to the beads took place at a force lower than 160 tons, no movement of the blank relative to the beads took place at a blank holding force of 80 tons in an actual test when using the non-parallel beads according to the present invention. This means that due to the increase in the bead resistance by the beads being oriented non-parallel to the drawing profile, the necessary blank holding force decreases thereby decreasing the press capacity. This also means that if the press capacity is maintained constant, the bead clearance e can be larger than the conventional bead clearance e', so that it will take less time and less skill to adjust the bead clearance in the method according to the present invention than in the conventional method.

The cushion ring 6 may tilt and increase the bead clearance e. However, if the increased clearance is in the allowable bead clearance limit increased due to the non-parallel beads, there will be no problems. Therefore, the bead clearance adjustment will not need, in some circumstances, a dynamic adjustment using actual panels, but would require only a static adjustment. As a result, a great deal of work and time can be omitted in the bead clearance adjustment.

Further, because the blank holding force is reduced to about a half of the conventional blank holding force, abrasion of the die and the beads is unlikely to occur, so that a stable drawing can be performed for a relatively long time period.

Furthermore, because the bead clearance e is larger than the conventional one e', rub of the blank by the beads 1 is weakened, and the plated metal of the blank is prevented from peeling off and adhering to the die surface or the blank surface. Further, because radius $r_d$ of the corner of the bead groove (concave bead) and radius $r_b$ of the corner of the bead protrusion (convex bead) do not need to be very small, even if a blank movement relative to the beads 1 occurs, hardening of the blank due to back and forth bending at the beads will not be severe and no crack due to the blank hardening will occur.

Figure 10:
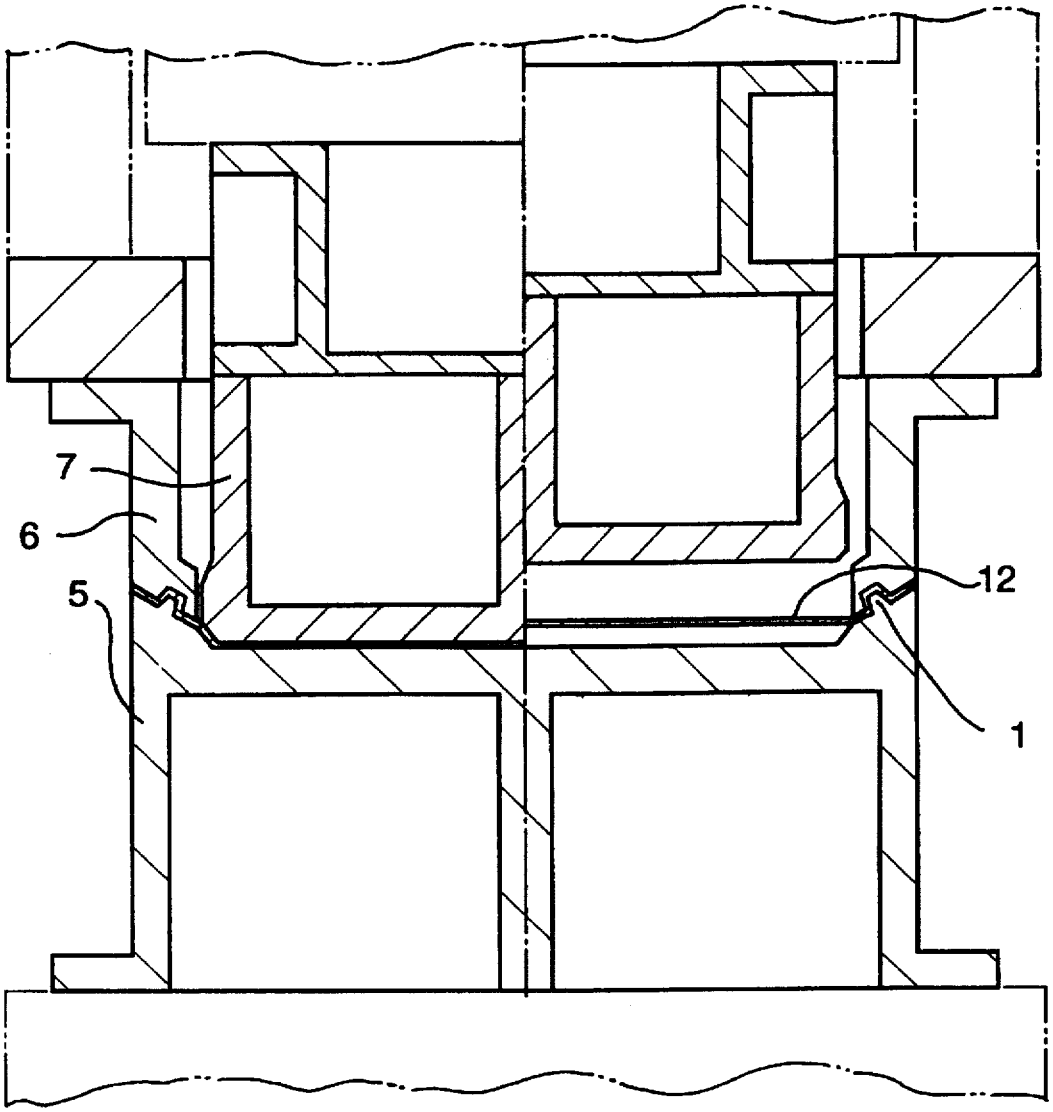
FIG. 10 is a cross-sectional view of a double-action drawing apparatus in which a drawing method according to the present invention is conducted, wherein the left side portion thereof is shown in a position after forming and the right side portion thereof is shown in a position before forming.
Figure 11:
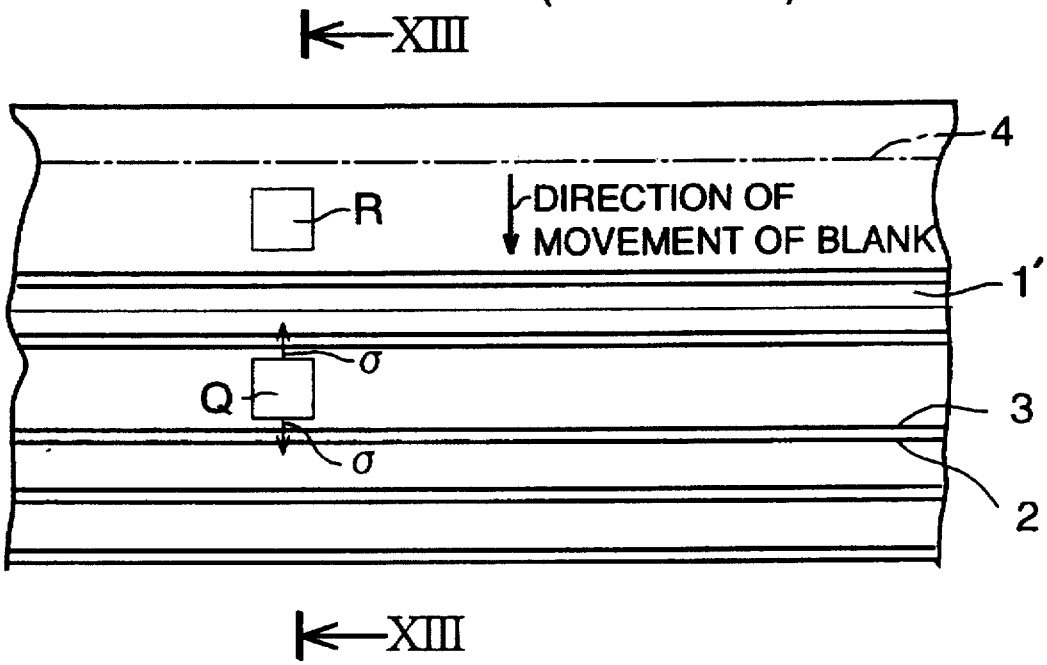
FIG. 11 (PRIOR ART)
FIG. 11 is a partial view of a blank holding surface and a bead of a cushion ring of a drawing apparatus used in conducting a conventional drawing method.
Figure 12:
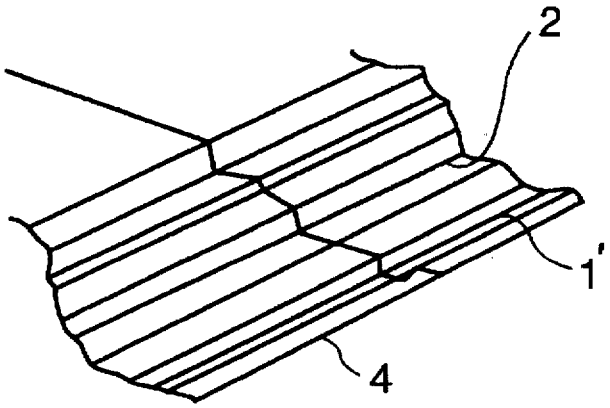
FIG. 12 (PRIOR ART)
FIG. 12 is an oblique view of the blank holding surface and the bead of FIG. 11.
Figure 13:
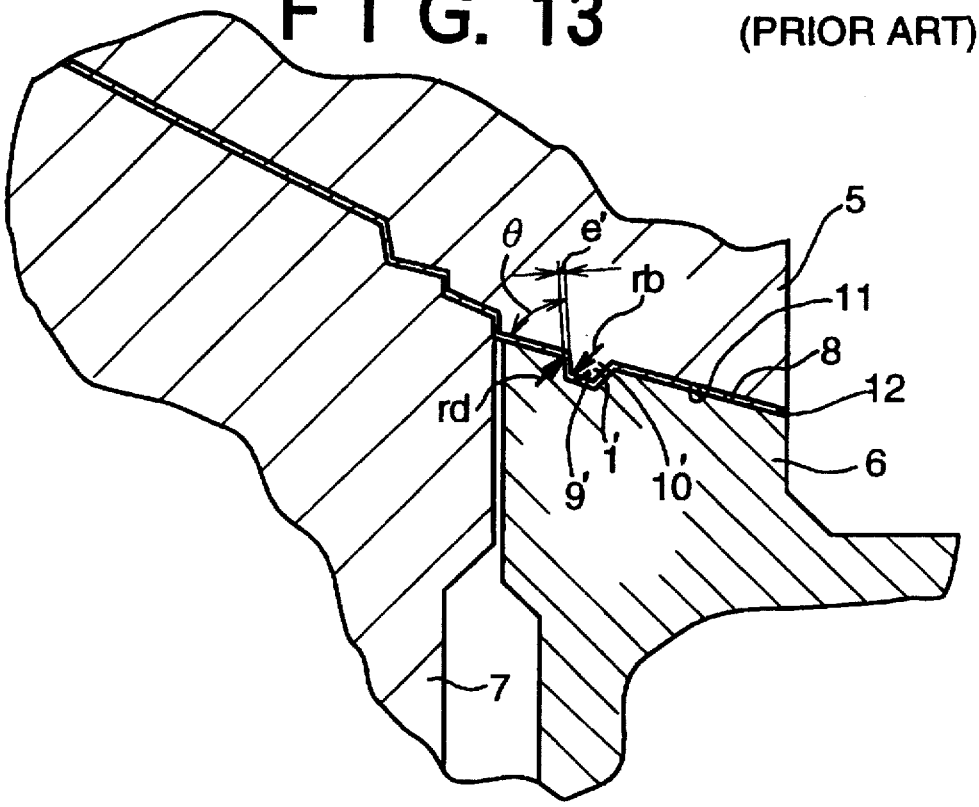
FIG. 13 (PRIOR ART)
FIG. 13 is a cross-sectional view of the blank holding surface and the bead taken along line XIII—XIII of FIG. 11.
Figure 14:
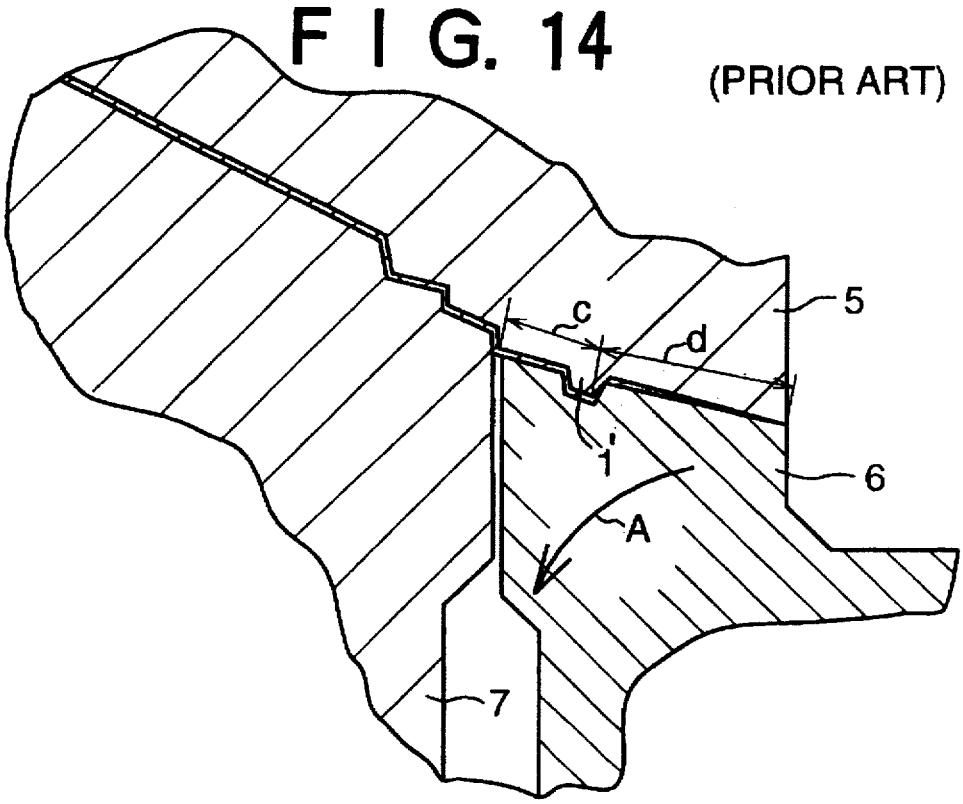
FIG. 14 (PRIOR ART)
FIG. 14 is a cross-sectional view of the drawing apparatus of FIG. 11 in a state where the cushion ring tilts a little.

Though the above explanation has been made taking the single-action drawing as an example, the method and apparatus can be applied to a double-action drawing. In the double-action drawing, as illustrated in FIG. 10, first a blank holder (upper blank holder) 6, fixed to an outer ram of a press machine, is lowered to hold a blank 12 between the blank holder 6 and a lower die 5 opposing the blank holder 6. Then, a punch 7, fixed to an inner ram of the press machine, is lowered to draw the blank 12. The beads 1 having at least a portion non-parallel to drawing profile is formed to blank holding surfaces of the blank holder 6 and the opposing die 5. Explanation about the beads 1 and the action thereof in the single-action drawing can be used as explanation about the beads 1 and the action thereof in the double-action drawing, by reading the cushion ring 6, the upper die 5, the blank holding surface 8 of the cushion ring 6, the blank holding surface 11 of the upper die 5, and the lower die 7 in the single-action drawing as the upper holder 6, the lower die 5, the blank holding surface 8 of the upper blank holder 6, the blank holding surface 11 of the lower die 5, and the upper die punch 7 in the double-action drawing, respectively.

According to the drawing method and apparatus according to the present invention, since drawing is performed using the beads having at least a portion non-parallel to a drawing profile, the bead resistance can be increased without reducing the bead clearance or the bead clearance can be increased without changing the bead resistance.

Although the present invention has been described with reference to a specific exemplary embodiment, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A drawing method comprising the following steps of:

holding a blank between a blank holder and a die opposing said blank holder, said blank holder and said die including respective blank holding surfaces in which beads are formed for locking the blank between the blank holder and the die, said beads having at least a portion that varies in distance along a blank movement direction from a drawing profile of said blank in alternately an increasing distance and a decreasing distance from said drawing profile such that there is a plurality of at least one of said increasing distance and said decreasing distance; and drawing said blank by a punch while said blank is being held between said blank holder and said opposing die.

2. A method according to claim 1, wherein said drawing is single-action drawing.

3. A method according to claim 1, wherein said drawing is double-action drawing.

4. A drawing apparatus comprising:

a blank holder;

a die opposing said blank holder, said blank holder and said opposing die including respective blank holding surfaces in which beads are formed for holding a blank between the blank holder and the die, said beads having at least a portion that varies in distance along a blank movement direction from a drawing profile of said blank in alternately an increasing distance and a decreasing distance from said drawing profile such that there is a plurality of at least one of said increasing distance and said decreasing distance; and a punch for drawing said blank while said blank is being held between said blank holder and said opposing die.

5. An apparatus according to claim 4, wherein said portion of said beads that varies in distance from a drawing profile has an axis of symmetry.

6. An apparatus according to claim 4, wherein said portion of said beads that varies in distance from a drawing profile has an arcuate profile.

7. An apparatus according to claim 4, wherein said portion of said beads that varies in distance from a drawing profile has a wave-like profile.

8. An apparatus according to claim 4, wherein said portion of said beads that varies in distance from a drawing profile has a zigzag profile.

9. An apparatus according to claim 4, wherein said portion of said beads that varies in distance from a drawing profile has a trapezoidal cross-section.

10. An apparatus according to claim 4, wherein said portion of said beads that varies in distance from a drawing profile has a rectangular cross-section.

* * * * *